United States Patent [19]

Shepherd et al.

[11] 4,108,085

[45] Aug. 22, 1978

[54] DISPLAY STRUCTURE

[75] Inventors: Charles Grey Shepherd, Oakville; Brian Donald Yeoman, Milton, both of Canada

[73] Assignee: J.A. Wilson Display Limited, Mississauga, Canada

[21] Appl. No.: 777,187

[22] Filed: Mar. 14, 1977

[30] Foreign Application Priority Data

Nov. 16, 1976 [CA] Canada ..... 265817

[51] Int. Cl.[2] ..... A47B 9/00; A47B 3/00; A47B 57/20

[52] U.S. Cl. ..... 108/108; 108/111; 108/152; 211/187

[58] Field of Search ..... 108/153, 110, 108, 107, 108/111, 152; 211/135, 177, 186, 187; 248/242, 247, 248

[56] References Cited

U.S. PATENT DOCUMENTS

| | | | |
|---|---|---|---|
| 2,788,949 | 4/1957 | Gurries | 248/242 |
| 2,900,085 | 8/1959 | Levy | 108/110 X |
| 3,081,718 | 3/1963 | Shoffner | 108/108 |
| 3,101,681 | 8/1963 | Streater | 211/187 X |
| 3,196,812 | 7/1965 | Jacques | 108/152 |
| 3,263,821 | 8/1966 | Klene et al. | 108/108 X |
| 3,347,609 | 10/1967 | Mann | 211/135 X |
| 3,587,867 | 6/1971 | Fenwick et al. | 211/187 |
| 3,602,159 | 8/1971 | Marschak | 211/187 X |
| 3,765,344 | 10/1973 | Ferdinand et al. | 211/135 |
| 4,008,873 | 2/1977 | Travaglio etal. | 248/242 |

*Primary Examiner*—James T. McCall
*Attorney, Agent, or Firm*—Rogers, Bereskin & Parr

[57] ABSTRACT

The invention provides an improved display gondola which can be both readily assembled from basic parts and fully dismantled by unskilled personnel; which requires no separate fasteners in the assembly; and which can support both light duty and heavy duty shelves.

8 Claims, 13 Drawing Figures

DISPLAY STRUCTURE

This invention relates to a display gondola of a type having a base defining a platform and a wall positioned behind the platform and including uprights for supporting shelves, and perforated display panels for supporting lighter products.

Department stores and other larger retail outlets use various structures to support products which are displayed for removal by a purchaser. Such structures include counter tops, shelves, perforated display panels and various types of racks. Display gondolas have become more popular because of their flexibility and the resulting efficient use of floor space.

In general, a display gondola has a base and a wall upstanding from the base. The wall can be intermediate the front and rear of the base to define two platforms or it can be at the rear of the base if the gondola is to be effectively one-sided. The platform often has openings for inserting dividers and the wall normally includes uprights which can support removable shelves and a perforated display panel which is inserted between the uprights for receiving hooks or hangers to support lighter products. Many retail stores use two types of gondola; one for heavier items such as hardware; and one for lighter goods such as gloves, etc. An example of a structure suitable for use with heavier items is shown in Canadian Pat. No. 940,876.

Display arrangements are often changed and consequently, a display gondola should be readily dismantled into relatively small parts for rearrangement or for storage. Also, it would be preferable if a gondola could receive conventional shelf supports as well as heavy duty shelf supports. One type of gondola could then be used to display both light weight goods and heavier items. Such a gondola would permit ready assembly of displays carrying all of the items normally carried by two different types of gondola.

Accordingly, the present invention is intended to provide an improved display gondola which can be both readily assembled from basic parts and fully dismantled by unskilled personnel; which requires no separate fasteners in the assembly; and which can support both light duty and heavy duty shelves.

The invention will be better understood with reference to the drawings, wherein.

Figure 1:
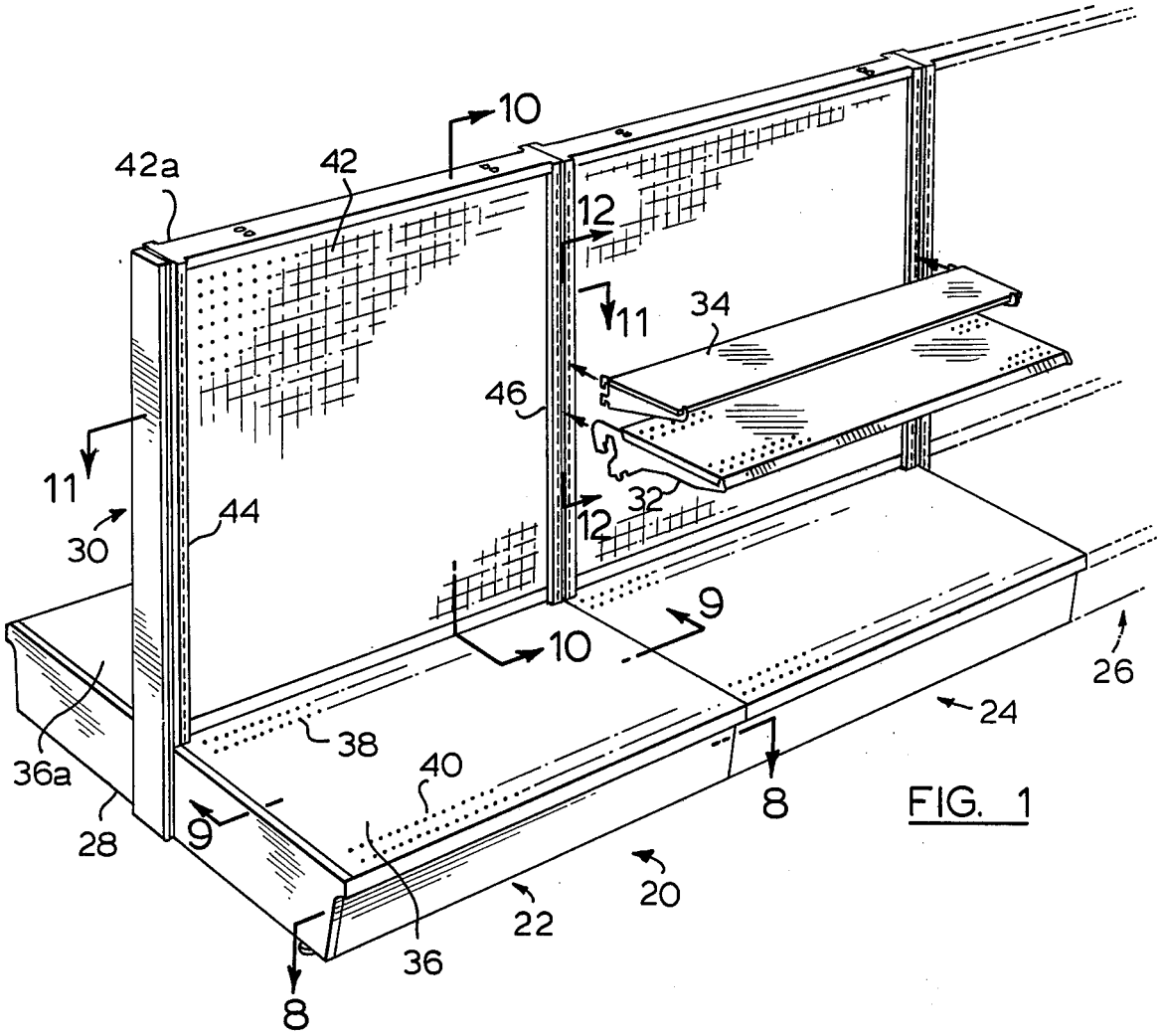
FIG. 1 is a perspective view of a display gondola made up in two sections, (a further section being indicated in ghost outline) the gondola incorporating a preferred embodiment of the invention and being viewed generally downwardly from one end and to one side of the gondola.
Figure 11:
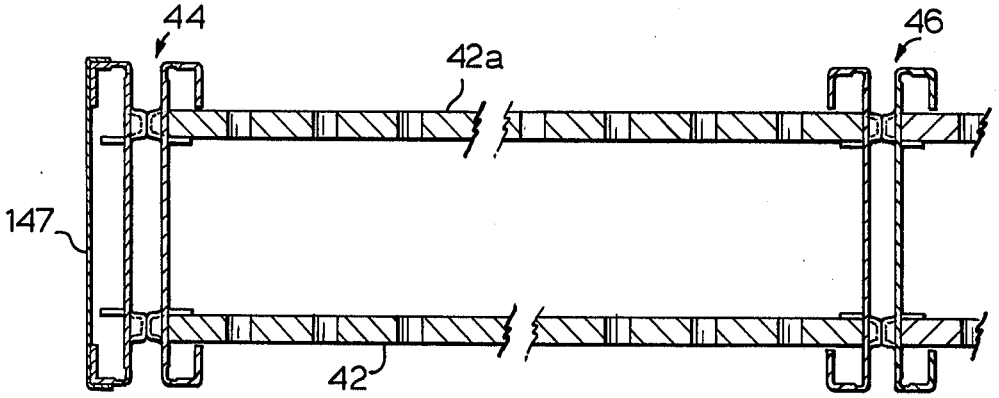
Figure 7:
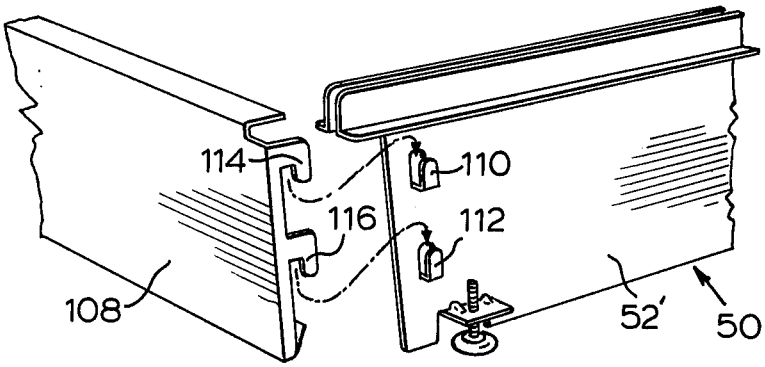
Figure 8:
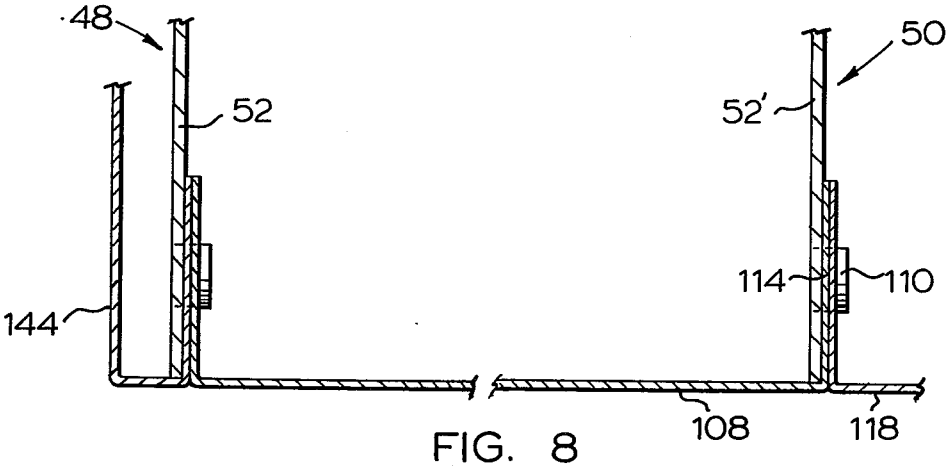
Figure 9:
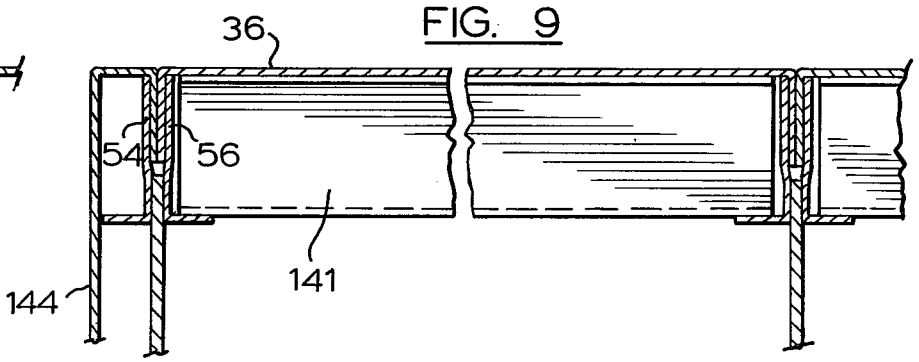
Figure 10:
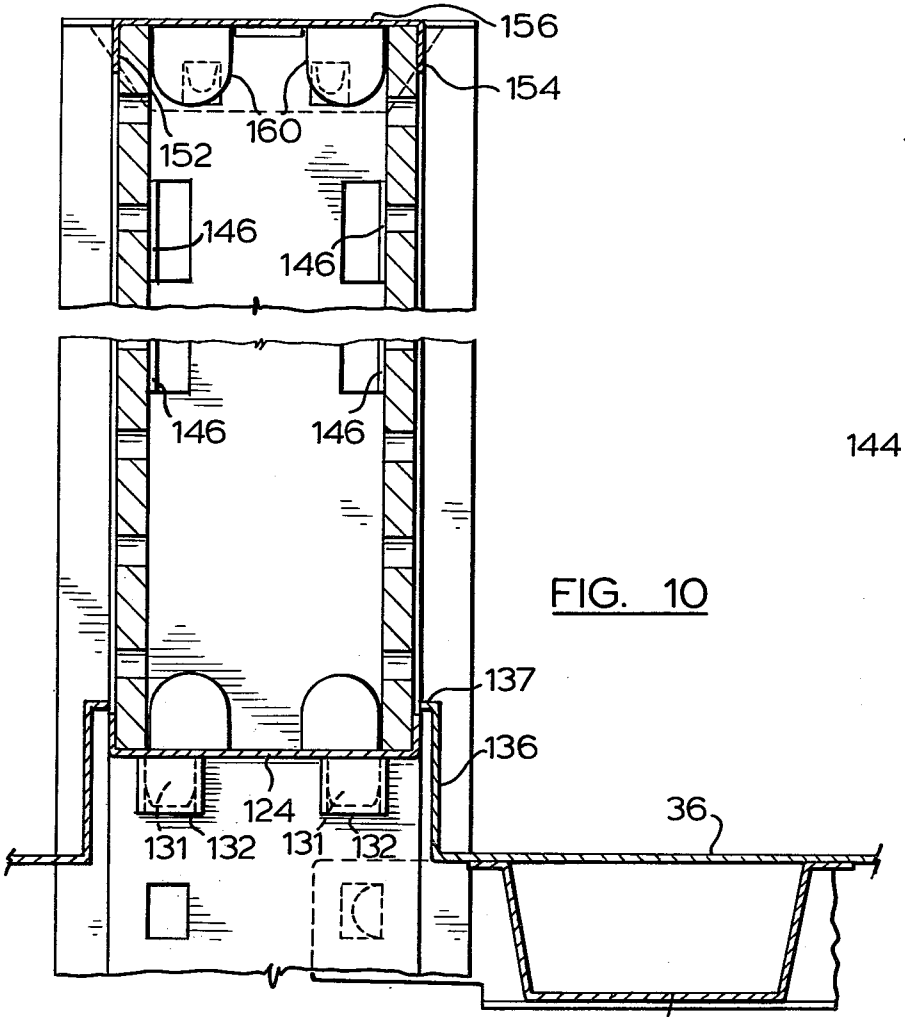
Figure 13:
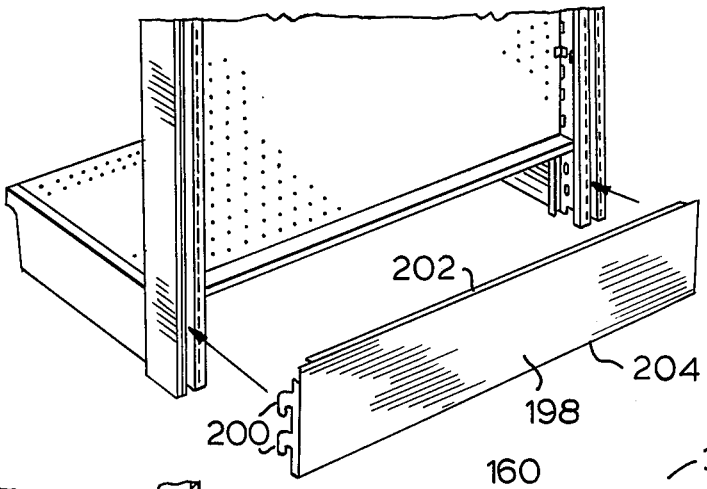
Figure 12:
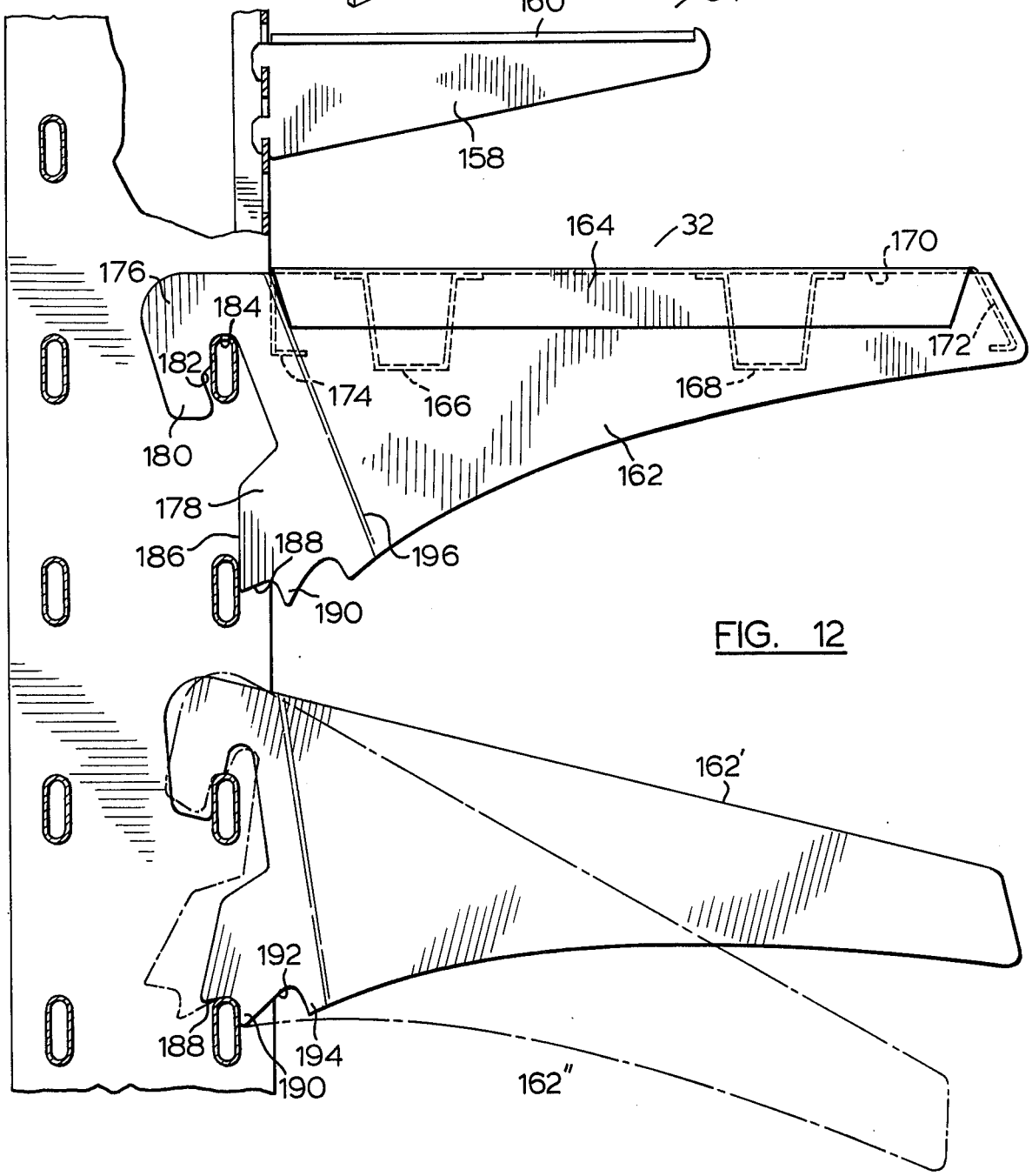

FIG. 7 (which appears adjacent to FIG. 2) is a perspective and exploded view illustrating the inter-connection between a platform support and a front kick plate;

FIG. 8 is a sectional plan view on line 8—8 of FIG. 1;

FIG. 9 is a sectional front view on line 9—9 of FIG. 1;

FIG. 10 is a sectional end view on line 10—10 of FIG. 1;

FIG. 11 (which appears adjacent to FIG. 1) is a sectional plan view on line 11—11 of FIG. 1;

FIG. 12 is a compound sectional end view taken generally on line 12—12 of FIG. 1 and illustrating the inter-connection of both a heavy duty shelf and a light duty shelf to uprights of the display gondola; and FIG. 13 is an exploded perspective view illustrating a portion of another embodiment of a display gondola and including a rear kick plate.

Reference is first made to FIG. 1 which illustrates a display gondola which is indicated generally by the numeral 20 and which includes first and second sections 22, 24. A further section 26 is indicated in ghost outline to show how the gondola can be extended by adding sections. The first section 22 is similar to the intermediate section 24 and will be described in detail with reference to subsequent drawings.

Section 22 includes a base 28 and a wall 30 dependent from a central portion of the base 28. The section can have shelves such as a heavy duty shelf 32 and a light duty shelf 34 attached to it as will be described with reference to FIG. 12.

The base 28 of section 22 includes platforms **36, 36*a* which have rows of perforations such as perforations 38, 40 for use in attaching dividers and the like. Also, the section 22 includes a pair of perforated display panels 42, 42*a* (see also FIG. 11) located between uprights 44, 46 for use in suspending articles of merchandise. As will be described, the uprights 44, 46 are capable of receiving conventional shelving such as the light duty shelf 34 as well as heavy duty shelving such as the shelf 32**.

Figure 2:
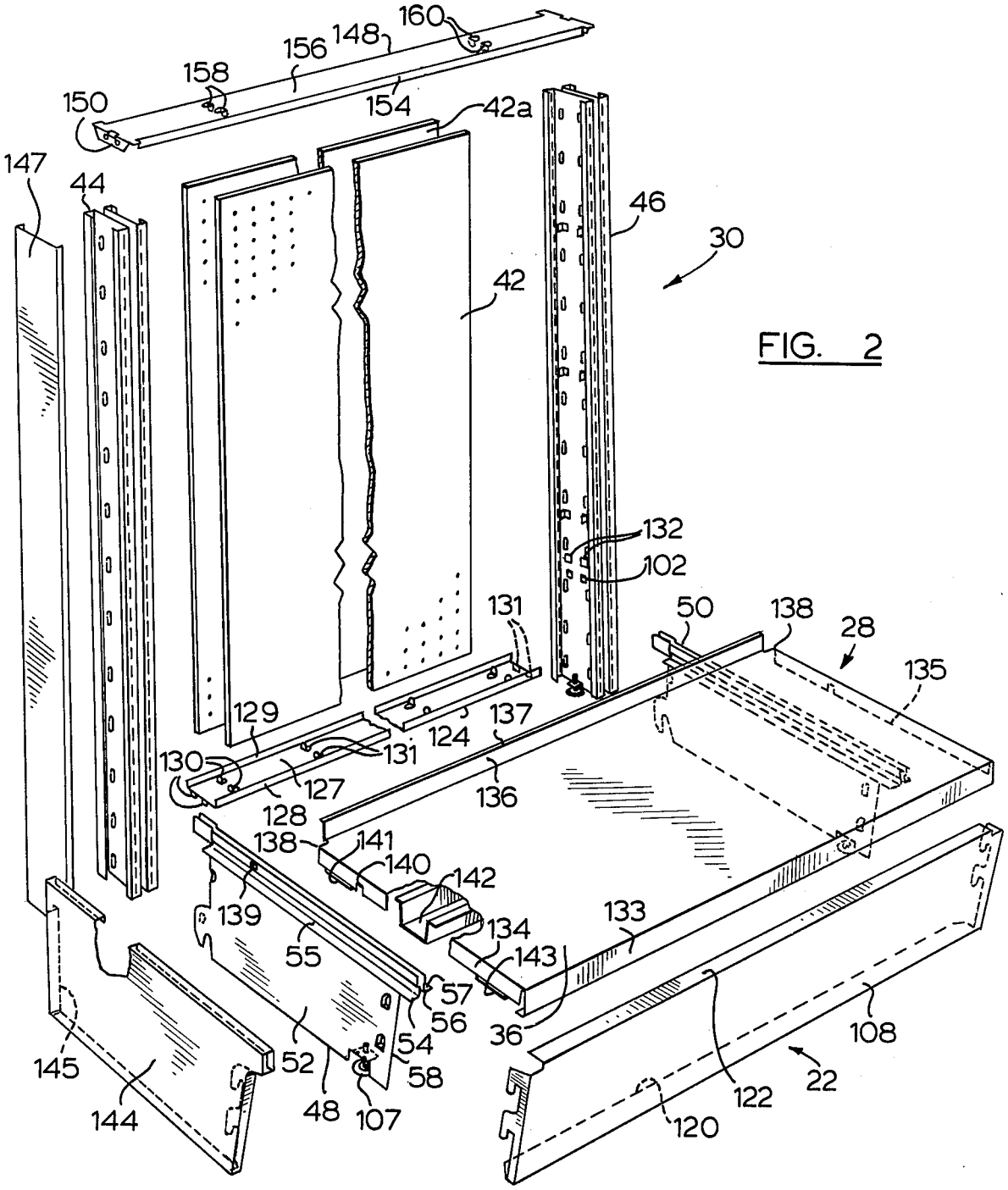
FIG. 2 is an exploded perspective view of some of the parts used to build the end section of the display gondola shown in FIG. 1.

The end section 22 will be further described with reference to the parts used to make this section and these parts will be described in the order of assembly. As seen in FIG. 2, the platform 36 is adapted to be supported by a pair of platform supports 48, 50 which are in turn adapted to be connected to the uprights 44, 46. The platform supports 48, 50 are interchangeable and the support 48 will be described as being typical of all such supports used in the display gondola 20 (FIG. 1).

Figure 5:
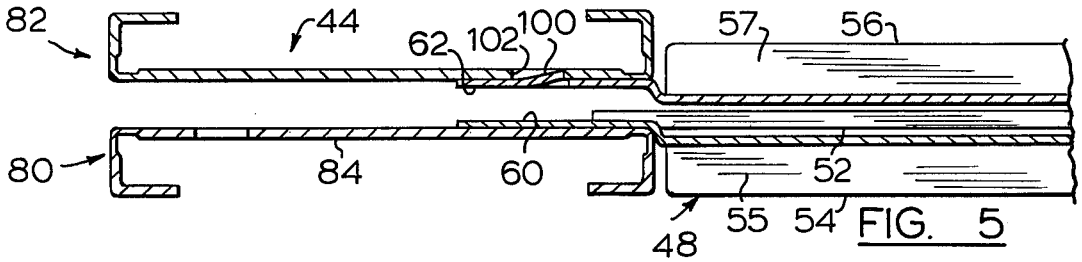
FIG. 5 is a sectional plan view on line 5—5 of FIG. 3, (some of the background parts having been omitted for clarity of drawing), this view being to a larger scale than that of FIG. 3.

As seen in FIGS. 2 to 6, platform support 48 consists of an upright and relatively stiff sheet steel main piece 52 which is generally rectangular. A pair of angle members 54, 56 are attached to the upper extremity of the main piece 52 in back-to-back relationship such that flanges 55, 57 extend horizontally and a platform such as platform 36 fits in a trough 59 between the upright portions of the angle members 54, 56 as will be described. Members 54, 56 extend beyond a forward extremity 58 (FIG. 2) of the main piece 52, and at the rearward extremity, the members include respective offset tongues 60, 62 (FIG. 5). These tongues extend in a generally parallel relationship for engagement in upright 44 and will be more fully described later.

Figure 3:
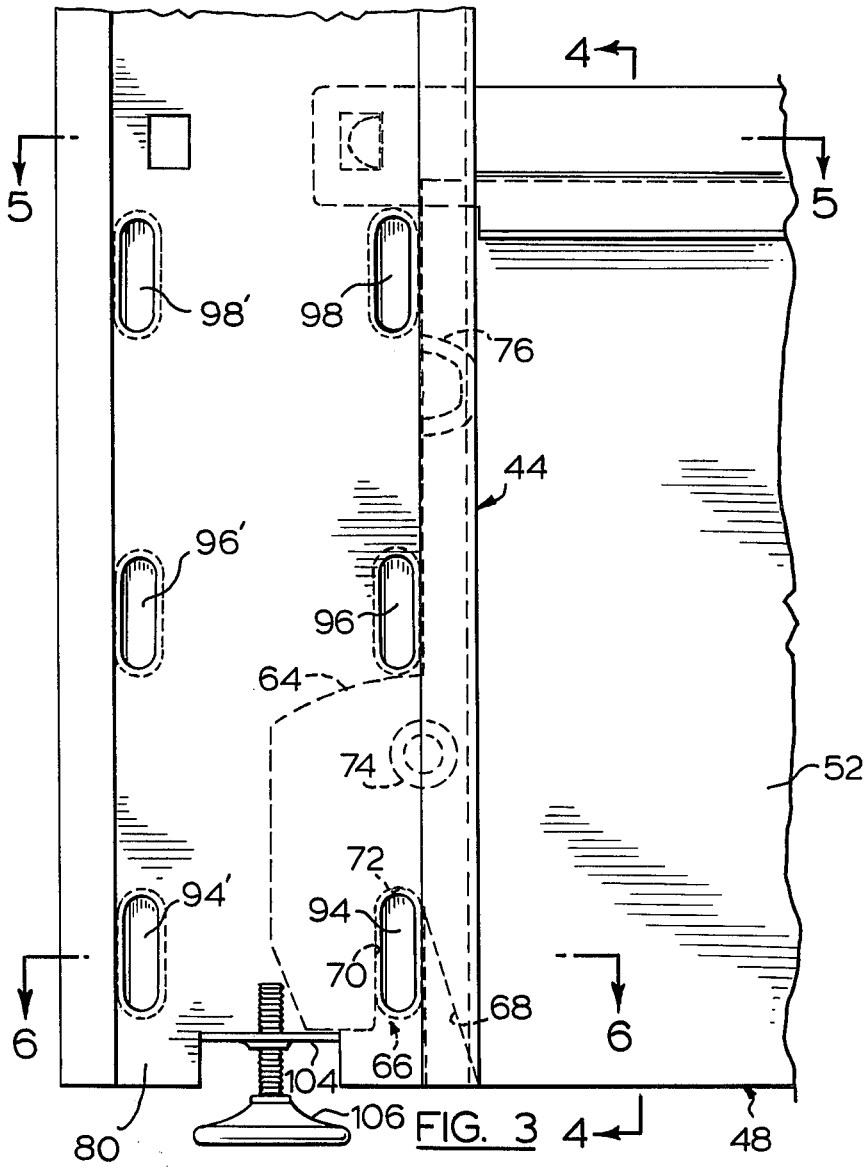
FIG. 3 is an end view of a portion of the display gondola showing the inter-connection between a platform support and an upright.
Figure 6:
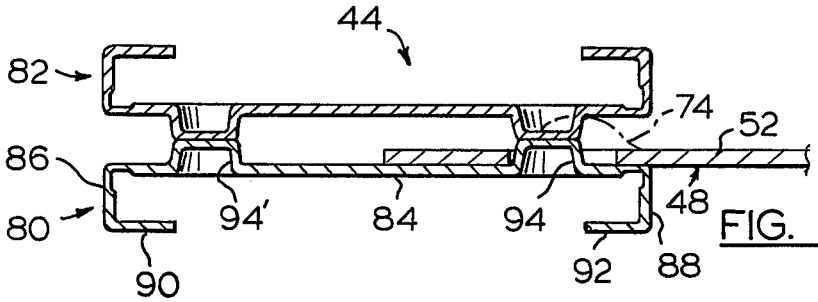
FIG. 6 is a view similar to FIG. 5 but showing a section on line 6—6 of FIG. 3, this view being to the same scale as FIG. 5.

As better seen in FIG. 3, the main piece 52 of the platform support 48 terminates at its lower rearward extremity in a generally hook-shaped projection 64 which extends downwardly to define a downwardly opening recess 66. This recess is defined by a rearwardly sloping forward edge 68, an upright rear edge 70, and by a curved top edge 72 which meets the edges 70 and 68 to complete the recess 66. A dimple 74 is formed out of the main piece 52 at the root of the projection 64 as best seen in FIG. 6. The dimple serves to positively locate the main piece 52 against an internal face of the upright 44 as will also be more fully explained later after the upright 44 has been described. A further deformation 76 in the rearward edge serves a similar purpose.

The upright 44 is typical of all other uprights and has cross-sections which are illustrated in FIGS. 5 and 6. Upright 44 includes respective first and second elements 80, 82 which are of similar construction and which are arranged in back-to-back relationship. Element 80 includes a central portion 84 and is bounded at its upright extremities by a pair of parallel and outwardly extending flanges 86, 88 which in turn terminate at aligned end pieces 90, 92. These end pieces extend towards one another from the outer extremities of the respective flanges 86, 88.

Figure 4:
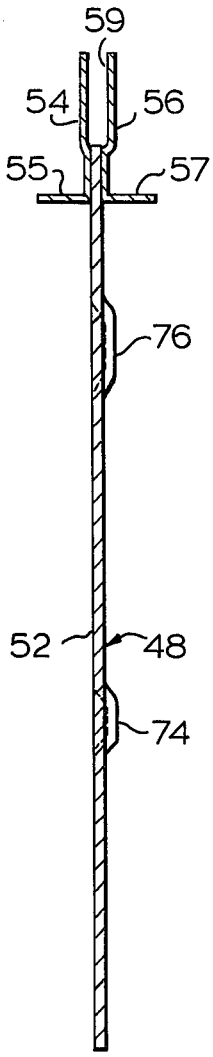
FIG. 4 is a sectional end view on line 4—4 of FIG. 3.

The element 80 is formed from strip steel into the shape shown in FIG. 4. It should be noted that the element is thinned at the junctions between the central portion 84 and the respective flanges 86, 88 for receiving the conventional light duty shelf 34 (FIG. 1) as will be described with reference to FIG. 12.

As seen in FIG. 3, the element 80 also includes a series of elongated deformations 94, 94', 96, 96', 98, 98', etc. The deformations are arranged in pairs and spaced by equal amounts along the length of the upright 44. Similar deformations on the second element 82 are arranged for face-to-face engagement with corresponding deformations on the element 80 and the two elements are then welded to one another at these deformations. Consequently, most of the central portion 84 of the element 80 (FIG. 6) is spaced from a corresponding central portion of the element 82 sufficient to receive parts of the platform support 48 as seen in FIGS. 3, 5 and 6.

As previously mentioned, the hook-shaped projection 64 seen in FIGS. 3 and 6 is adapted to be positioned between the elements 80, 82 and the dimple 74 and deformation 76 locate the main piece 52. In fact (and as seen in FIG. 6), the main piece 52 is engaged against an inwardly-facing surface of central portion 84 of element 80 and the dimple projections 94 and with the corresponding projection on 74 and deformation 76 are in contact with the corresponding surface of the element 82. As a result, the main piece 52 is offset slightly from the centre of upright 44. Consequently, the tongues 60, 62 on members 54, 56 must be offset sufficient to enter between the elements 80, 82 of upright 44 as shown in FIG. 5.

The tongues 60, 62 are spaced apart sufficiently to engage snugly between the elements 80, 82 and the tongue 62 includes a barb 100 formed from the material of the tongue and deflected outwardly for engagement in an opening 102 in the element 80. It will be appreciated that the preferred structure is being described and that alternative arrangements could be used. For instance, barbs could be provided on both of the tongues; or a barb or barbs on the uprights and a corresponding opening or openings in the tongues.

It will be evident from FIGS. 3 to 6 that the platform support 48 can be engaged in the upright by first entering the hook-shaped projection 64 between a pair of deformations such as deformations 94, 96 and then by rotating the support 48 upwardly, the tongues 60, 62 can be brought into engagement in the opening between the elements 80, 82. As this rotation takes place the hook-shaped portion 64 locates about the deformation 94 and the barb 100 engages in the opening 102 of the element 80 to lock the support 48 in the upright 44. Once assembled, any load placed on the wall 30 (FIG. 1) will tend to collapse this wall towards the platform 36. This is prevented by the engagement of a rearward edge of main piece 52 against the deformations 96, 98 and by the engagement of the rear edge 70 of recess 66 on the deformation 94. The barb 100 simply prevents separation of the wall away from the base during assembly and during any subsequent movement of the finished gondola. The barb can be released by inserting any convenient blunt implement in opening 102 (FIG. 5) to deflect the barb 100 out of this opening so that the tongues 60, 62 can be withdrawn from the upright 44. As this takes place, the platform support 48 and the upright 44 must be rotated away from one another.

It should be noted that in the assembled condition shown in FIG. 3, the extremity of the hook-shaped portion 64 falls short of the centre of the upright 44 so that a similar hook-shaped portion of a platform support can now be engaged from the opposite side of the upright 44 to support platform **36*a* (FIG. 1**).

The upright 44 also includes a leveller shown in FIG. 3. The leveller consists of an internally threaded element 104 which is welded in openings provided in the first and second elements 80, 82 of the upright 44 to receive a conventional adjustable foot 106. Similarly, levellers are provided on all of the platform supports. For instance, support 48 includes a leveller 107 (FIG. 2) threadably engaged in a suitable deformation in the support 48.

Reference is again made to FIG. 2 to describe further parts in the order of their assembly. After the platform supports 48, 50 (and the supports associated with platform **36*a*) have been engaged in the corresponding uprights 44, 46, a front kick plate 108 is connected to the supports 48, 50. The end of the kick plate associated with support 50 is shown below FIG. 2 in FIG. 7**. This Fig. illustrates the connection between these parts and is typical of all such connections.

Support 50 includes vertically spaced lugs 110, 112 which are deformed out of the main portion of the support 50 to effectively define slots into which respective hooked engagement portions 114, 116 of the kick plate 108 can be engaged. The engagement portions 114, 116 are engaged by first locating these portions just above the lugs 110, 112 and in contact with the main portion of support 50, and by then sliding the kick plate 108 downwardly to bring the lower extremities of the engagement portions behind the lugs. It will be seen from FIG. 8 (which is a sectional view on line 8—8 of FIG. 1) that a further front kick plate 118 can also be engaged in the lips 110, 112 and that the support 48 is interchangeable with the support 50.

It should be noted both that the kick plate 108 and a further adjacent kick plate are engaged in the lugs 110, 112 at one side of the main piece 52' and that the main piece is not central with respect to the uprights (as was previously described with reference to FIGS. 5 and 6.)

The front kick plate 108 (as shown in FIG. 2) is rigidified by a bottom flange 120 and by an upper flange 122 on which the platform 36 will rest as will be described.

After the front kick plate 108 has been engaged in the platform supports 48, 50, a display panel support element 124 is positioned in engagement with the uprights 44, 46 to additionally locate these uprights in spaced-apart relationship preparatory to adding the platform 36.

As seen in FIG. 2, the support element 124 has a horizontal main portion 127 bordered by upright side flanges 128, 129. Between these flanges, a series of pairs of upright tabs 130, 131, etc. are formed out of the main portion 127. The tabs are rounded and positioned such that the spacing between the respective flanges 128, 129 and adjacent tabs is just sufficient to receive and locate the panels **42, 42*a* with the lower edges of these panels in engagement with the main portion 127. The rounded upper extremities of the tabs aid in entering the panels into position on the main portion 127**.

Each of the ends of the support element 124 includes respective pairs of downwardly extending projections 130, 131 for engagement behind keeps raised out of the uprights 44, 46. One pair of such keeps can be seen in FIG. 2 denoted by numeral 132 for receiving projections 131. Similar keeps are provided in the hidden side of upright 44.

The element 124 is added to the partial assembly by first entering the projections into the openings in the uprights and by then moving the element downwardly. The platform 36 is essentially of a relatively light gauge sheet metal having a generally L-shaped front flange 133, end flanges 134, 135 and an upturned rear flange 136 which terminates in a horizonal portion 137 (which is best seen in FIG. 10). The flange 136 and horizontal portion 137 are proportioned so that these parts fit snugly between uprights 44, 46 when the end flange 134 is positioned in the trough 59 formed between the angle members 54, 56 of the platform support 52, and when the end flange 135 is similarly located relative to the support 50. Consequently, because the rear flange 136 is shorter than the overall length of the platform 36, there are two rear shoulder portions 138 formed for engagement with fronts of the respective uprights 44, 46 to prevent rearward movement of the platform 36. Forward motion is prevented by the interengagement of a tab 139 formed from the upright portion of angle member 54 and a recess 140 in end flange 134 of the platform 36. Similar structure is provided in flange 135 and platform support 50. The platform 36 also includes three elongated channel elements 141, 142 and 143 attached to the underside of the main portion of platform 36 to rigidify the structure.

After the support element 124 has been engaged in the uprights, the platform 36 is placed on the supports 48, 50 by first engaging the lower lip of L-shaped front flange 133 under the end of angle member 56 and under an end of the complementary angle member of support 50. Using a slight rearward force to maintain this engagement the platform 36 is rotated downwardly onto the supports 48, 50 with the front of the platform 36 positioned above the flange 122 of the kick plate 108.

The base 28 (FIG. 1) is then completed by adding corresponding parts associated with platform **36*a* to thereby complete the base. However, if the section 22 is to be used as an end section (as shown), then platform trim plates such as plate 144 are added together with a trim strip 147. Plate 144 has portions which correspond both to the end flange 134 of platform 36 and to the engagement portions 114, 116 (FIG. 7) of the front kick plate 108, as well as a generally L-shaped rear flange 145 for engagement between elements of upright 44. Consequently, the trim plate 144 can be added to the platform 48 as illustrated in FIGS. 1, 8 and 9. There would of course be a trim plate of the opposite hand at the other end of the base 28 (FIG. 1**) to complete the structure.

The strip 147 is a simple channel shape and engages frictionally on the upright 44 as seen in FIG. 11.

It will be seen from FIG. 9 that the spacing between the angle members 54, 56 is chosen to accommodate two flanges of adjacent platforms. Similarly the kick plate 108 and an adjacent kick plate are both engaged in the lugs 110, 112 shown in FIG. 7. The snug engagements of pairs of platforms and pairs of kick plates in the platform supports aid in rigidifying the structure.

The panel 42 and corresponding panel **42*a* can now be slipped vertically downwards into the support element 124. The panels are guided in the upright by guide pieces 146 (FIG. 10) formed out of the material of the upright and positioned so that the panels 42, 42*a*, etc. fit between these pieces and the adjacent end pieces 90, 92 (FIG. 6) of the uprights. The panels are enclosed at their tops by a cap 148 (FIG. 2). As seen in FIG. 2, this cap has end portions 150 (one of which is seen in FIG. 2) for downward engagement into the space between the elements of the uprights. The end portion 150 shown in FIG. 2 engages in the space in upright 44 between the first and second elements 80, 82 and the corresponding end portion engages in the upright 46 in a similar fashion. As also seen in FIG. 10, the cap includes respective vertical portions 152, 154 which extend downwardly from respective front and rear edges of a top portion 156**.

As seen in FIG. 2, the vertical portions 152, 154 are cut short of the ends of the cap 148 to accommodate parts of the uprights 44, 46. Consequently, and as better seen in FIG. 1, on assembly the cap 148 combines with the uprights 44, 46 to provide a frame effect around the panels **42, 42*a***.

The cap 148 also includes pairs of tabs 158, 160, the tabs 160 being shown in more detail in FIG. 10. It will be seen from this Fig. that the tabs are generally semicircular in shape to aid in locating the display panels **42, 42*a*. As drawn in FIG. 10, the panels 42, 42*a* are spaced on outer extremities of the tabs 160 and located at their upper extremities between these tabs and the flanges 152, 154**.

Once the wall 30 (FIG. 1) is completed, the panels **42, 42*a* in the wall resist torsional forces applied in a vertical plane and the platform 36 resists torsional forces applied in a horizontal plane. Consequently, the finished section 22** is quite rigid.

If the basic section 22 is to be extended as indicated in FIG. 1, the upright 46 and platform support 50 form a basis to start assembling section 24. Similarly, any number of sections can be added.

The gondola has been assembled without the use of any tools. On disassembly, the parts can be removed quite readily although a blunt implement of some sort is needed to disengage tongue 62 from the upright 44 and to disengage corresponding tongues on other platform supports from the corresponding uprights. However, in some instances, the uprights can be stored with the platform supports assembled and then the disassembly is kept to a minimum. Further, once disassembly has taken place, there are no fasteners of any kind which could be lost before the structure is to be reassembled.

In some displays, the display panel 42 will support the merchandise whereas in others, shelves such as the heavy duty shelf 32 or the light duty shelf 34 will be used. The use of these shelves will now be described with reference to FIG. 12.

FIG. 12 is a compound section in that the major part of the view is a section taken slightly to one side of the centre of upright 46. However, at the upper extremity of FIG. 12, the section is taken through one of the elements constituting the upright 46 to illustrate how the light duty shelf 34 is attached to the upright.

As is common in the art, the shelf 34 is made up in three parts. There are two standard shelf supports 158 which carry the shelf piece 160 and these supports can be engaged in the uprights as will be described. By contrast, the heavy duty shelf 32 is of unitary construction and includes a pair of shelf supports 162 which are of a different form and which will be described after completing the description of the light duty shelf.

As previously described with reference to FIG. 4, the uprights are of relatively heavy material but are thinned at corners of the elements where the central portion (such as portion 84) meets the flanges 86, 88. Further, slots are provided in the elements where the material is thinned in order to accommodate the shelf supports 158 which are of a conventional form and readily available. Consequently, although the uprights are of relatively heavy material, they can nevertheless accommodate conventional shelf supports 182. It will be evident from FIG. 1 that each upright includes two rows of slots extending longitudinally of the uprights for receiving conventional shelf supports 158. The spacing between the uprights is such that conventional shelf pieces 160 will fit on the gondola 20 with a shelf of one section aligned with the shelf of the next section.

A further advantage of the present display gondola is that heavy duty shelving such as the shelf 32 can be accommodated without losing the facility to accommodate the conventional shelves 34 and their shelf supports 158. This is achieved by having the shelf support 162 attachable to the uprights about the deformations between the elements of the upright. Each shelf support 162 is accommodated between an outer flange 164 of the shelf 32 and reinforcing elements 166, 168 of the same shelf. A main portion 170 of the shelf includes a front lip 172 which further rigidifies the shelf 32 and presents a finished appearance. Also, a rear L-shaped flange 174 is provided to further rigidify the structure. Assembly is completed by welding the main portion 170 to the supports 162.

Each of the shelf supports 162 is shaped to support the shelf 32 in one of three different positions. The shelf can be horizontal as illustrated by shelf support 162 in FIG. 12; at a preferred angle as illustrated by the shelf support 162' which is also seen in FIG. 12; and at a fully inclined position which is shown in ghost outline at 162''.

Shelf support 162 includes a rearward hook 176 and a rearward abutment 178. The hood 176 includes a leg 180 and two steps 182, 184 which are located inwardly and forwardly from the leg 180. With the shelf support 162 in the horizontal position, the step 184 fits about any one of the deformations in the upright and at the same time, a rearward face 186 of the abutment 178 is in engagement with the deformation below that which is in engagement with the second step 184. Consequently, the shelf 32 is supported in a horizontal position.

When the shelf support is to be placed in one of the positions indicated by the numerals 162' and 162'', the first step 182 is brought into engagement with the deformation of the upright. In the position 162' the abutment 178 is in engagement with a further deformation such that a first support face 188 rests on the lower deformation and a first stop 190 is in engagement with the deformation to prevent any further downward angular movement. In the ghost outline position 184'', a second support face 192 rests on the deformation and a second stop 194 engages the deformation to prevent further downward angular motion. Consequently, the stops 190, 194 define the angular position in which the shelf rests as shown at 184' and 184''.

The first step 182 engages the deformation both at the inner side and at the top in both the positions 184' and 184'' and is shaped to fit snugly against the deformation in the ghost outline position. Nevertheless, there is sufficient support in both positions so that the shelf is located positively in the uprights.

It will be evident that the shelves can be positioned between any pair of uprights. Also, the spacing between elements of the uprights is such that two of the shelves 32 can be positioned in horizontal alignment with one another because the elements of any one support are spaced sufficiently to receive two of these shelf supports. However, in order to accommodate the flange 164, the supports are preferably formed such that an outer portion is offset towards the associated reinforcing elements 166, 168 at a boundary 196 sufficient to create space for the flange 164.

In the event that the gondola is to be used with a single platform, then the platform **36*a* (FIG. 1) and associated platform supports can be replaced by a rear kick plate 198 as shown in FIG. 13. This kick plate includes pairs of downwardly extending hooks 200 at the ends (only one pair being shown in FIG. 13) and these hooks engage the deformations in the uprights to locate the rear kick plate. The kick plate also includes a top flange 202 and lip 204 and if required, the second display panel 42*a*** can be used although it is not seen in this view.

The display gondola shown in FIG. 1 is an exemplary construction incorporating the invention. Variations can be made. For instance, in the event that the gondola is to stand against a wall, the structure shown in FIG. 13 could be used with or without the rear kick plate 218. The length of the gondola can be varied by adding further sections and any conventional display attachments can be used if they can be attached either to a perforated display panel or to conventional uprights.

The uprights can also be varied within the scope of the invention. The pairs of deformations in the elements of the uprights can be replaced by any suitable structure. For instance, separate pieces could be welded to the elements or one deformation formed in one of the elements and welded to the other element which could be free of deformations.

What we claim is:

1. An upright for use in display gondolas of a type having a wall to which shelving can be attached, the upright being for use in the construction of the wall for attachment of the shelving and comprising:

a pair of central portions spaced from one another in parallel relationship;

means bridging the central portions at a plurality of locations spaced equally along the length of the upright to receive heavy duty shelf supports the bridging means comprising deformations created in at least one of the central portions and attached to the other of the central portions; and a pair of flanges lying in a common plane perpendicular to the central portions and respectively dependent one from each of the central portions in directions away from one another, each of the flanges defining openings spaced along the length of the flanges to receive light duty shelf supports and the thickness of the material of the flanges being less about said openings than the thickness of the central portions and less than the thickness of the remainder of the flanges.

2. The combination of an upright as claimed in claim 1 and a platform support for use in constructing a base adjacent said wall, the platform support comprising: (a) a downwardly-extending hook-shaped projection for engagement over a lowermost one of said bridging means; (b) tongue means located above the hook-shaped projection and engageable between said central portions; (c) a barb defined by one of the tongue means and the central portions, the other of the tongue means and the central portions defining an opening for lockingly receiving the barb to prevent separation of the platform support and the upright; and (d) a rear portion engageable against a further one of the bridging means above the hook-shaped portion with the hook-shaped projection engaged about said lowermost one of said bridging means to thereby prevent rotation of the platform support upwardly towards the upright.

3. The combination as claimed in claim 2 and further comprising a front kick plate, the platform support further comprising location means adjacent a forward end of the platform support, and the kick plate defining means engageable in the location means to couple the kick plate to the platform support with the kick plate lying generally perpendicular to the platform support.

4. A display gondola comprising:

a pair of uprights spaced apart from one another, each of the uprights being as claimed in claim 1;

a pair of platform supports adapted to be attached one to each of the uprights such that the supports extend perpendicularly from a plane containing the flanges of both uprights, each platform support comprising: (a) a downwardly-extending hook-shaped projection for engagement over a lowermost one of said bridging means of a first of the uprights; (b) tongue means located above the hook-shaped projection and engageable between said central portions of said first of the uprights; (c) a barb defined by one of the tongue means and the central portions of this upright, and the other of the tongue means and the central portions defining an opening for lockingly receiving the barb to prevent separation of the platform support and the upright; (d) a rear portion engageable against a further one of the bridging means above the hook-shaped portion with the hook-shaped projection engaged about said lowermost one of said bridging means to thereby prevent rotation of the platform support upwardly towards the upright; and, (e) means defining an upwardly-opening trough extending longitudinally along the upper extremity of the platform support;

a platform adapted to be supported on the platform supports and including end flanges dependent downwardly for engagement one in each of the troughs of the pair of platform supports to rigidify the structure against torsional forces applied in a horizontal plane; and a cap adapted to be coupled to upper extremities of the uprights.

5. A display gondola as claimed in claim 4 and further comprising: a display panel support element adapted to be coupled to the uprights in a position spaced below the top cap; and a display panel, the top cap and uprights defining means adapted to co-operate with the support element to locate the display panel in place in the gondola.

6. A display gondola comprising:

a base;

a wall extending upwardly from the base and including: at least two uprights spaced apart and each of the uprights being as claimed in claim 1; at least one display panel engaged between the uprights, the display panel terminating adjacent upper extremities of the uprights;

a top cap adapted to be releasably engaged in upper ends of the uprights to contain the display panel between the uprights, the top cap including vertical end portions for engagement in respective spaces between the central portions of the pair of uprights, and front and rear flanges having ends engageable against the uprights such that the spaces between the ends of these flanges and the adjacent end portions creates a friction fit when the end portions are engaged downwardly into the respective openings in the uprights with said ends of the flanges in engagement with the respective uprights.

7. A display gondola as claimed in claim 5 in which the top cap includes downwardly extending end portions for engagement between respective central portions of the uprights and front and rear flanges having ends which engage the respective uprights upon engaging the end portions in the uprights to create a friction fit which limits the possibility of accidental separation of the cap from the uprights.

8. A display gondola comprising:

a pair of uprights spaced apart from one another, each of the uprights including a pair of central portions spaced from one another in parallel relationship, means bridging the central portions at a plurality of locations spaced equally along the length of the upright to receive heavy duty shelf supports, and a pair of flanges lying in a common plane perpendicular to the central portions and respectively dependent one from each of the central portions in directions away from one another, each of the flanges defining openings spaced along the length of the flanges to receive light-duty shelf supports;

a pair of platform supports adapted to be attached one to each of the uprights of the respective bottom ends of the uprights and to extend away from the uprights in parallel relationship, each of the platform supports including means defining a trough at an upper surface thereof, the trough extending longitudinally of the platform support;

a platform having downwardly extending end flanges for locating engagement in the troughs of the platform supports and an upwardly-turned lip at the rear of the platform; and a top cap adapted to be coupled to upper extremities of the uprights.

* * * * *